US005775133A

United States Patent [19]

Nilsson

[11] Patent Number: 5,775,133

[45] Date of Patent: Jul. 7, 1998

[54] METHOD FOR PRODUCING A KNITTED GARMENT

[75] Inventor: Eivor Nilsson, Uppsala, Sweden

[73] Assignee: Kriss AB, Sparsor, Sweden

[21] Appl. No.: 795,484

[22] Filed: Feb. 11, 1997

[30] Foreign Application Priority Data

Aug. 12, 1994 [SE] Sweden ..... 9402722

[51] Int. Cl.[6] ..... A41B 1/24

[52] U.S. Cl. ..... 66/176; 66/171

[58] Field of Search ..... 66/169 R, 170, 66/171, 173, 175, 176, 201, 1 R, 172 R

[56] References Cited

U.S. PATENT DOCUMENTS

| | | | |
|---|---|---|---|
| 1,072,640 | 9/1913 | Nydegger | 66/176 |
| 1,572,434 | 2/1926 | Kaiser . | |
| 3,093,989 | 6/1963 | Breitinger | 66/176 |
| 3,813,901 | 6/1974 | Betts et al. | 66/176 |
| 4,040,275 | 8/1977 | Castello . | |
| 4,087,991 | 5/1978 | Robinson et al. | 66/176 |
| 5,214,941 | 6/1993 | Essig | 66/175 |
| 5,321,959 | 6/1994 | Mitsumoto . | |

FOREIGN PATENT DOCUMENTS

| | | |
|---|---|---|
| 92308499 | 9/1992 | European Pat. Off. . |
| 0705929 | 10/1996 | European Pat. Off. . |
| 1549777 | 8/1979 | United Kingdom . |
| WO 9605345 | 2/1996 | WIPO . |

*Primary Examiner*—Peter Nerbun
*Assistant Examiner*—Larry D. Worrell, Jr.
*Attorney, Agent, or Firm*—Merchant, Gould, Smith, Edell, Welter & Schmidt

[57] ABSTRACT

A method for producing knitted ready-made garments type waistcoat or jacket includes the step of: knitting a piece of tricot (10) having a rectangular configuration with two long sides (12, 13), two short sides (11) and at least two fold markings (18, 19, 21, 23, 24); folding the piece of tricot in at least two places, substantially in parallel with the short sides (11) for forming the back (14) and side parts (15) of the jacket; forming the remaining parts of the tricot piece at the short sides a divided front (16) with a substantially v-shaped front neck part; making an arm opening at each side part of the tricot piece; knitting each divided front part (16) with two or more fold markings (18, 19, 21, 23, 24), of which at least two of these markings (18, 19) extend substantially from the respective long side and meet each other in a vertex (20) at a distance from the short sides (11) of the tricot piece; and folding each divided front part (16) along the fold markings and is joined together to at least double thickness.

7 Claims, 1 Drawing Sheet

METHOD FOR PRODUCING A KNITTED GARMENT

TECHNICAL FIELD

This is a continuation of PCT/SE95/00902 applicatin filed 31 Jul. 1995.

The present invention refers to a method for producing knitted ready-made garments of the type waistcoat or jacket, comprising knitting a piece of tricot having a rectangular configuration with two long sides, two short sides and at least two fold markings, folding the piece of tricot in at least two places, substantially in parallel with the short sides for forming the back- and side parts of the jacket, wherein the remaining parts of the tricot piece at the short sides, form a divided front with a substantially V-shaped front neck part, and making an arm opening at each side part of the tricot piece.

BACKGROUND OF THE INVENTION

Traditional manufacturing of ready-made garments, e.g. jackets or waistcoats, usually comprises cutting sections and stitching them together into a complete garment. This assembly of the garment is labor-intensive and requires a high degree of precision in order to make the garment fulfill the demands regarding quality and trueness to size. If the garment is provided with a pattern, cutting and assembly should be performed with regard to the pattern which often causes spillage of fabric.

The same goes for knitted garments, with the exception that the different parts which form the garment may be knitted to substantially the right shape separately, without any cutting. However, the assembly of the parts is just as labor intensive and involves the risk of faults in the production.

It is known to manufacture knitted jackets or waistcoats by knitting a large rectangle. This knitting may be performed in computer controlled knitting machine with double bed, which enables patterns and structure knitting. By folding the rectangle at two places, it will form the back piece, the side pieces and a divided garment front. This method reduces the manual work effort during assembly of the garment. Openings are made at the sides, either for forming the arm openings of a waistcoat, or for mounting the as of a jacket.

The design and the manner in which the material in the divided front of the garment hangs, is very important for the appearance of the garment. Therefore, it is common to manufacture these so called "front pieces" separately and mount them at the two short ends of the rectangular piece.

Alternatively, it is also possible to provide each front piece with a folding, so that two facings are provided and a V-shaped neck opening. The folds may also be produced in such a way that each front piece is folded in parallel to the two short ends of the rectangular piece, whereafter further folds are produced so that the facings are obtained and the V-shaped opening. One disadvantage with this is that the two times double folding results in four knitted layers which may lead to a garment which is unnecessarily heavy. One drawback with this prior art which involves forming the front pieces by folding the short ends of the rectangle, is that one is comparatively rigidly confined to certain basic variants.

THE TECHNICAL PROBLEM

One object of the present invention is therefore to further simplify and reduce the manual work effort during manufacturing of these garments, so that it does not involve mounting of separately manufactured front pieces nor folding to more than double thickness.

THE SOLUTION

For this purpose, the method according to the invention is characterized in that each front part is knitted with two or more fold markings, of which at least two of these markings extend substantially from the respective long side and meet each other in a vertaz at a distance from the short sides of the tricot piece, and that each front part is folded along the fold markings and is joined together to at least double thickness.

By this method, it will be more simple to provide aesthetically attractive front pieces and one will have much more than before in designing such front pieces.

DESCRIPTION OF THE DRAWINGS

The invention will be described here below with reference to an embodiment shown in the accompanying drawing, in which FIG. 1 schematically shows a rectangular tricot piece with fold markings according to a first embodiment of the invention in the left half, and in folded condition in the right half, and FIG. 2 correspondingly shows a rectangular tricot piece having fold markings according to a second embodiment of the invention.

DESCRIPTION OF EMBODIMENTS

Figure 1:
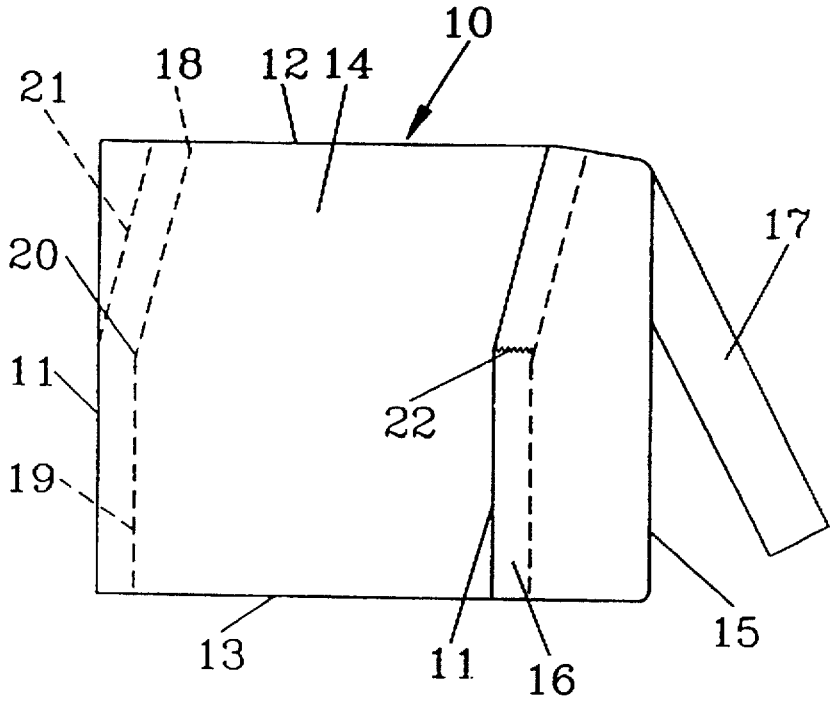

In FIG. 1, a rectangular knitted tricot piece 10 is shown with short sides 11 and long sides 12, 13, during completion to a ready-made jacket having a divided front and a V-shaped neck opening.

The tricot piece is folded as is shown at the right part of FIG. 1, substantially in parallel with the short sides 11 for forming the back part 14 and side parts 15 of the jacket. The remaining parts of the tricot piece 10 adjacent the short sides 11 form the divided front part 16. An arm hole has bean made at the side of the tricot piece for mounting a sleeve 17.

As the left part of FIG. 1 shows, each front part 16 is knitted with two straight fold markings 18, 19 extending from a respective long side 12, 13 and meets each other in a vertex 20 at a distance from the short side 11 of the tricot piece. Another fold marking 21 ads between the short side 11 and the upper long side 12, substantially parallel to the fold marking 18.

As the right part of FIG. 1 shows, the front part 16 is folded, at first along the marking 21 and then along the markings 18, 19 so that they will be located at the inside 15 of the garment. The folded parts are secured by stitching partly along the shoulder part of the garment and partly at 22.

Figure 2:
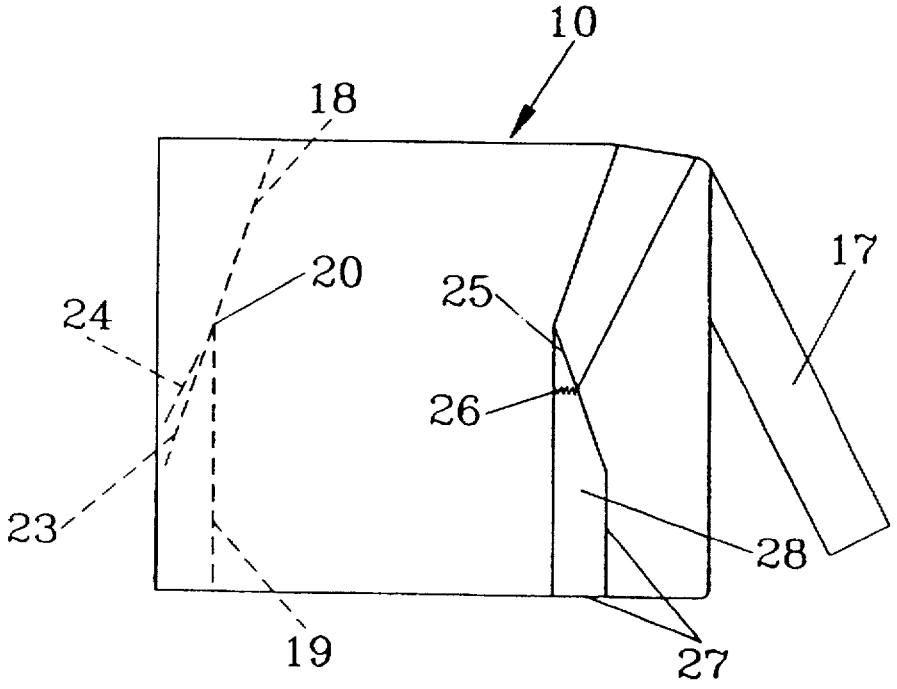

FIG. 2 shows correspondingly, another variant of the invention. Here the folding is performed towards the outside of the garment. For this object, the tricot piece is provided with fold markings 23, 24 in addition to the fold markings 18, 19. Thus, the folding is first made outwards along the markings 18, 19. Then surplus material is folded inwards along the markings 23, 24. The front part is secured, partly along the shoulder part of the garment and partly at 25 and 26. The upper part of the front part then forms a facing, while the bottom part forms a pocket 28 on the front part via an angle stitching 27. Pockets may also be formed directly during knitting of the rectangular tricot piece by a continuous knitting.

The tricot piece 10 may entirely or partly be knitted with one or more patterns in two or more different colors, in such a way, that the pattern appears with its reverse side and right side at the same side of the tricot piece.

The fold markings of the front part may be provided by knitting in yarn having a contrasting color. An alternative and more advantageous method is to provide the fold a of the front art by knitting the tricot piece over a narrow segment in a single bed over a number of needles. This means that the fold marking forms a genuine physical fold in the garment material, which contributes to the faultless hanging of the garment and ensures an attractive appearance which is maintained even if the garment is washed. Fold markings may also be produced by some other structure knitting of the tricot piece. In this way, the fold markings may also become an active part of the total design of the garment and thus may increase its purchase value.

Other fold variants than the shown and described are of course conceivable. Owing to the elasticity of the knitted material, it is possible to combine two or more folds, so that these meet in an angle at a distance from the edge of the rectangular tricot piece, without deformation of the final shape of the garment making it less attractive. Modern technique in knitting also makes it possible to vary elasticity in certain parts of the tricot piece where it is needed. Also, the fold markings 18, 19 do not have to extend all the way out to the long sides 12, 13.

I claim:

1. A method for producing knitted ready-made garments, waistcoat or jacket type comprising the steps of:

knitting a piece of tricot having a rectangular configuration with two long sides, two short sides, and at least two fold markings;

folding the piece of tricot in at least two places, substantially in parallel with the short sides for forming back and side parts of the jacket, wherein remaining parts of the piece of tricot at the short sides, form a divided front with a substantially V-shaped front neck part; and making an arm opening at each side part of the piece of tricot;

knitting each divided front part with the fold markings, of which at least two of the fold markings extend substantially from the respective long side and meet each other in a vertex at a distance from the short sides of the tricot piece; and folding the each divided front part along the fold markings and joining the each divided front part together to at least double thickness of the piece of tricot.

2. A method according to claim 1, wherein the piece of tricot is knitted at least partly with at least one pattern in at least two different colors, in such a way that the pattern appears on its reverse side and right side at the same side of the piece of tricot wherein folding is performed so that the pattern appears on the right side at one side of the piece of tricot.

3. A method according to claim 1, wherein the at least one fold marking of each front piece is provided by knitting in yarn having a contrasting color.

4. A method according to claim 1, wherein the at least one fold marking of each front piece is formed by knitting the piece of tricot over a narrow segment on a single bed over a number of needles.

5. A method according to claim 4, wherein the at least one fold marking is formed by structure knitting of the piece of tricot.

6. A method according to claim 1, wherein double folding of each divided front part is fastened by means of stitches to form a pocket.

7. A method according to claim 1, wherein the piece of tricot is provided with knitted pockets.

* * * * *